US011555232B2

(12) United States Patent
Otaki et al.

(10) Patent No.: US 11,555,232 B2
(45) Date of Patent: Jan. 17, 2023

(54) AUSTENITIC STAINLESS STEEL MATERIAL

(71) Applicant: NIPPON STEEL CORPORATION, Tokyo (JP)

(72) Inventors: Nao Otaki, Tokyo (JP); Norifumi Kochi, Tokyo (JP); Takahiro Izawa, Tokyo (JP); Naoki Sawawatari, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 84 days.

(21) Appl. No.: 17/162,058

(22) Filed: Jan. 29, 2021

(65) Prior Publication Data

US 2021/0254201 A1 Aug. 19, 2021

(30) Foreign Application Priority Data

Feb. 14, 2020 (JP) ..... JP2020-023263

(51) Int. Cl.

| | |
|---|---|
| ***C22C 38/48*** | (2006.01) |
| ***C22C 38/00*** | (2006.01) |
| ***C22C 38/02*** | (2006.01) |
| ***C22C 38/58*** | (2006.01) |
| ***C22C 38/42*** | (2006.01) |
| ***C22C 38/44*** | (2006.01) |
| ***C22C 38/54*** | (2006.01) |
| ***C22C 38/06*** | (2006.01) |
| ***C22C 38/50*** | (2006.01) |
| ***C21D 8/02*** | (2006.01) |
| ***C22C 38/46*** | (2006.01) |

(52) U.S. Cl.

CPC ..... *C22C 38/48* (2013.01); *C21D 8/0226* (2013.01); *C22C 38/001* (2013.01); *C22C 38/002* (2013.01); *C22C 38/005* (2013.01); *C22C 38/02* (2013.01); *C22C 38/06* (2013.01); *C22C 38/42* (2013.01); *C22C 38/44* (2013.01); *C22C 38/46* (2013.01); *C22C 38/50* (2013.01); *C22C 38/54* (2013.01); *C22C 38/58* (2013.01); *C21D 2211/001* (2013.01)

(58) Field of Classification Search

None

See application file for complete search history.

(56) References Cited

U.S. PATENT DOCUMENTS

| | | | | |
|---|---|---|---|---|
| 2011/0272070 | A1 | 11/2011 | Jakobi et al. | |
| 2011/0318593 | A1 | 12/2011 | Takahashi et al. | |
| 2019/0010565 | A1* | 1/2019 | Kochi | C22C 38/06 |
| 2019/0127816 | A1 | 5/2019 | Matsubara et al. | |
| 2019/0127832 | A1* | 5/2019 | Kochi | C22C 38/34 |
| 2021/0062314 | A1* | 3/2021 | Ugawa | C22C 38/48 |

FOREIGN PATENT DOCUMENTS

| | | | | |
|---|---|---|---|---|
| EP | 1997921 | A2 * | 12/2008 | C22C 19/00 |
| JP | 2012505314 | A | 3/2012 | |
| WO | 2010113830 | A1 | 10/2010 | |
| WO | 2018088070 | A1 | 5/2018 | |

OTHER PUBLICATIONS

English language machine translation of EP-1997921-A2 to Bosch et al. Generated Jun. 15, 2022. (Year: 2022).*

* cited by examiner

*Primary Examiner* — Brian D Walck

(74) *Attorney, Agent, or Firm* — Greer, Burns & Crain, Ltd.

(57) ABSTRACT

To provide an austenitic stainless steel material having a high creep strength and a high creep ductility even in a high-temperature environment at 800° C. or more. An austenitic stainless steel material according to the present disclosure has a chemical composition that includes, in mass %: C: 0.060% or less; Si: 1.0% or less; Mn: 2.00% or less; P: 0.0010 to 0.0400%; S: 0.010% or less; Cr: 10 to 25%; Ni: 25 to 45%; Nb: 0.2 to 2.0%; W: 2.5 to 6.0%; B: 0.0010 to 0.0100%: Al: 2.5 to 4.5%; and the balance being Fe and impurities, and satisfies Formulae (1) and (2), and the sum of the content of dissolved Nb and the content of dissolved W is 3.2 mass % or more.

$$(W/184+Nb/93)/(C/12)\geq 5.5 \quad (1)$$

$$(W/184+Nb/93)/(B/11)\leq 450 \quad (2)$$

In Formulae (1) and (2), the content in mass % of the corresponding element is substituted for each symbol of element.

8 Claims, No Drawings

AUSTENITIC STAINLESS STEEL MATERIAL

TECHNICAL FIELD

The present disclosure relates to a steel material. In particular, it relates to an austenitic stainless steel material.

BACKGROUND ART

Steel materials used for a chemical plant facility, such as a petroleum refining plant or a petrochemical plant, are used for a long time in a high-temperature environment that includes chemical materials such as hydrocarbons. Therefore, the steel materials used for the chemical plant facility are required to have not only oxidation resistance and carburization resistance but also high creep strength in the high-temperature environment. Such steel materials used for the chemical plant facility include the austenitic stainless steel material.

As known, if the austenitic stainless steel material contains 2.0% or more of Al, the oxidation resistance and the carburization resistance of the austenitic stainless steel material in the high-temperature environment described above can be effectively increased. When the austenitic stainless steel material contains 2.0% or more of Al, a coating primarily made of $Al_2O_3$ (referred to as an alumina coating, hereinafter), rather than a coating primarily made of $Cr_2O_3$ (referred to as a chromia coating, hereinafter), is formed on the surface of the steel material. The alumina coating is more densely formed than the chromia coating. Therefore, the alumina coating reduces the entry of oxygen and carbon from the high-temperature environment into the steel material. As a result, the oxidation resistance and the carburization resistance of the austenitic stainless steel material are increased.

Austenitic stainless steel materials on which the alumina coating is to be formed are disclosed in WO2010/113830 (Patent Literature 1), WO2018/088070 (Patent Literature 2), and JP2012-505314A (Patent Literature 3), for example.

The austenitic stainless steel material disclosed in Patent Literature 1 is a casting of a heat resistant alloy containing, in mass %: C: 0.05 to 0.7%, Si: more than 0% to 2.5% or less, Mn: more than 0% to 3.0% or less, Cr: 15 to 50%, Ni: 18 to 70%, Al: 2 to 4%, a rare earth metal: 0.005 to 0.4%, and W: 0.5 to 10% and/or Mo: 0.1 to 5%, the balance being Fe and an inevitable impurity. A barrier layer is formed on the surface of the casting. The barrier layer is an $Al_2O_3$ layer having a thickness of 0.5 μm or more, and 80% or more of the area of the outermost surface of the barrier layer is made of $Al_2O_3$. At the interface between the $Al_2O_3$ layer and the casting, Cr-based particles having a higher Cr concentration than the base metal of the alloy are dispersed. In this literature, it is described that since the outermost surface of the barrier layer ($Al_2O_3$ layer) contains less Cr oxide, and Cr-based particles are dispersed at the interface between the $Al_2O_3$ layer and the casting, the barrier layer is less likely to peel off, and the oxidation resistance and the carburization resistance can be maintained. Furthermore, in this literature, it is described that Ti, Zr and Nb are contained to form carbides, thereby increasing the creep rupture strength of the austenitic stainless steel material.

A tubular body disclosed in Patent Literature 2 is a tubular body used in a high-temperature atmosphere that is formed from a heat resistant alloy containing, in mass %: Cr: 15% or more, Al: 2.0% or more, and Ni: 18% or more, the inner surface of the tubular body has an arithmetic average roughness (Sa) of the three-dimensional surface roughness that satisfies a relation that $1.5 \leq Sa \leq 5.0$, and the skewness (Ssk) of the surface height distribution of the tubular body satisfies a relation that $|Ssk| \leq 0.30$. In this literature, it is described that the area fraction of the alumina barrier layer formed on the inner surface of the tubular body can be increased by setting the surface roughness of the tubular body to fall within an appropriate range. Furthermore, in this literature, it is described that Nb is contained to form a carbide, thereby increasing the creep strength of the austenitic stainless steel material.

The nickel-chromium alloy disclosed in Patent Literature 3 contains, in mass %: C: 0.4 to 0.6%, Cr: 28 to 33%, Fe: 15 to 25%, Al: 2 to 6%, Si: 2% or less, Mn: 2% or less, Nb: 1.5% or less. Ta: 1.5% or less, W: 1.0% or less, Ti: 1.0% or less. Zr: 1.0% or less, Y: 0.5% or less, Ce: 0.5% or less, Mo: 0.5% or less, and N: 0.1% or less, and the balance being Ni and impurities depending on the melting process. In this literature, it is described that, since the nickel-chromium alloy has the chemical composition described above, a high oxidation resistance and a high creep rupture strength are achieved. Specifically, Nb, Ti, Ta and W are contained to form carbides and/or carbo nitrides, thereby achieving a high creep strength.

CITATION LIST

Patent Literature

Patent Literature 1: WO2010/113830
Patent Literature 2: WO2018/088070
Patent Literature 3: JP2012-505314A

SUMMARY OF INVENTION

Technical Problem

In Patent Literatures 1 to 3 described above, in order to increase the creep strength, precipitation strengthening by carbides and/or carbo-nitrides produced during use in the high-temperature environment is mainly used. By the way, the steel materials used for the chemical plant facility can be exposed to a high-temperature environment at 800° C. or more that includes chemical materials such as hydrocarbons as described above. In this specification, the high-temperature environment at 800° C. or more that includes chemical materials such as hydrocarbons is also referred to simply as a "high-temperature environment at 800° C. or more". In such as high-temperature environment at 800° C. or more, not only high creep strength but also high creep ductility is required. In Patent Literatures 1 to 3, no mention is made as to achieving both high creep strength and high creep ductility in the high-temperature environment at 800° C. or more.

An object of the present disclosure is to provide an austenitic stainless steel material that has a high creep strength and a high creep ductility even in a high-temperature environment at 800° C. or more.

Solution to Problem

An austenitic stainless steel material according to the present disclosure includes a chemical composition that consists of, in mass %:

C: 0.060% or less,
Si: 1.0% or less,
Mn: 2.00% or less,
P: 0.0010 to 0.0400%,

S: 0.010% or less,
Cr: 10 to 25%.
Ni: 25 to 45%,
Nb: 0.2 to 2.0%,
W: 2.5 to 6.0%,
B: 0.0010 to 0.0100%,
Al 2.5 to 4.5%,
N: 0 to 0.030%,
Cu: 0 to 2.0%,
Ta: 0 to 3.0%,
Mo: 0 to 3.0%,
Ti: 0 to 0.20%,
V: 0 to 0.5%.
Hf: 0 to 0.10%,
Zr: 0 to 0.20%,
Ca: 0 to 0.008%,
rare earth metal (REM): 0 to 0.10%, and
the balance being Fe and impurities, and satisfies Formulae (1) and (2), wherein a sum of a content of dissolved Nb and a content of dissolved W is 3.2 mass % or more:

$$(W/184+Nb/93)/(C/12)\geq 5.5 \quad (1)$$

$$(W/184+Nb/93)/(B/11)\leq 450 \quad (2)$$

where a content in mass % of a corresponding element is substituted for each symbol of element in Formulae (1) and (2).

Advantageous Effects of Invention

An austenitic stainless steel material according to the present disclosure has a high creep strength and a high creep ductility even in a high-temperature environment at 800° C. or more.

DESCRIPTION OF EMBODIMENT

The inventors have investigated and studied austenitic stainless steel materials that can have both high creep strength and high creep ductility in a high-temperature environment at 800° C. or more that includes chemical materials such as hydrocarbons, and made the following findings.

As means for increasing the creep strength in a high-temperature environment, as described in Patent Literatures 1 to 3, there is precipitation strengthening that involves production of a carbide or a carbo-nitride (referred to as a carbide or the like, hereinafter). In the temperature range less than 800° C., the precipitation strengthening by a carbide or the like effectively increases the creep strength. However, in the high-temperature environment at 800° C. or more, the precipitation strengthening by a carbide or the like may be unable to sufficiently maintain the creep strength. In the high-temperature environment at 800° C. or more, a carbide once produced in the steel material may dissolve again during use of the steel material. In that case, it is considered that the carbide can no longer contribute to the precipitation strengthening, and the creep strength cannot be maintained.

In view of this, the inventors studied means for precipitation strengthening in the high-temperature environment at 800° C. or more that can replace the precipitation strengthening by a carbide or the like. As a result, the inventors found that, if a Laves phase ($Fe_2(W, Nb)$) containing W and Nb is formed instead of a carbide or the like such as Nb carbide during use of the steel material in the high-temperature environment at 800° C. or more, the precipitation strengthening can be maintained and a high creep strength is achieved even in the high-temperature environment at 800° C. or more. The Laves phase containing Wand Nb has a higher melting point than the carbide such as Nb carbide. Therefore, in the high-temperature environment at 800° C. or more, the Laves phase containing W and Nb is less likely to dissolve than the carbide or the like. As a result, in the high-temperature environment at 800° C. or more, the precipitation strengthening is more likely to be maintained, and a higher creep strength is achieved in the high-temperature environment at 800° C. or more.

To produce the Laves phase containing W and Nb, production of W carbide and Nb carbide or the like needs to be reduced so that W and Nb can be used for production of the Laves phase. In order to reduce the production of W carbide and Nb carbide or the like, the inventors came up with an idea of reducing the content of C in the austenitic stainless steel material. As a result of study, it turned out that, if the content of C in the chemical composition described later is reduced to 0.060% or less, production of W carbide and Nb carbide or the like can be sufficiently reduced and the Laves phase containing W and Nb can be produced during use in the high-temperature environment.

The inventors further studied means for increasing the creep ductility in the high-temperature environment at 800° C. or more. To increase the creep ductility, strengthening the grain boundary is effective. If a fine Laves phase containing W and Nb is formed along the grain boundary, the grain boundary is strengthened by precipitation strengthening. As a result, both high creep strength and high creep ductility can be achieved in the high-temperature environment at 800° C. or more. To form a Laves phase containing W and Nb along the grain boundary during use of the steel material in the high-temperature environment at 800° C. or more, the steel material can advantageously contain B.

Based on the findings described above, the inventors studied chemical compositions of austenitic stainless steel materials. As a result, the inventors found that an austenitic stainless steel material can have both a high creep strength and a high creep ductility in a high-temperature environment at 800° C. or more if the austenitic stainless steel material has a chemical composition consisting of, in mass %, C: 0.060% or less, Si: 1.0% or less, Mn: 2.00% or less, P: 0.0010 to 0.0400%, S: 0.010% or less, Cr: 10 to 25%. Ni: 25 to 45%. Nb: 0.2 to 2.0%, W: 2.5 to 6.0%, B: 0.0010 to 0.0100%, Al: 2.5 to 4.5%, N: 0 to 0.030%, Cu: 0 to 2.0%, Ta: 0 to 3.0%. Mo: 0 to 3.0%. Ti: 0 to 0.20%. V: 0 to 0.5%. Hf: 0 to 0.10%, Zr: 0 to 0.20%. Ca: 0 to 0.008%, rare earth metal (REM): 0 to 0.10%, and the balance being Fe and impurities.

However, even the austenitic stainless steel material having the chemical composition described above may not have a sufficiently high creep strength and a sufficiently high creep ductility in the high-temperature environment at 800° C. or more. Then, the inventors further studied means for allowing the austenitic stainless steel material having the chemical composition described above to have a sufficiently high creep strength and a sufficiently high creep ductility in the high-temperature environment at 800° C. or more. As a result, the inventors found that an austenitic stainless steel material having the chemical composition described above has an increased creep strength and an increased creep ductility in the high-temperature environment at 800° C. or more if the contents of the elements in the chemical composition fall within the ranges described above, the chemical composition satisfies Formulae (1) and (2), and the sum of the content of dissolved Nb and the content of dissolved W is 3.2 mass % or more. These will be described in the following.

[Formulae (1) and (2)]

On the supposition that the contents of the elements in the chemical composition fall within the ranges described above, and the sum of the content of dissolved Nb and the content of dissolved W described later is 3.2 mass % or more, if the chemical composition satisfies Formulae (1) and (2) described below, the austenitic stainless steel material can have both a sufficiently high creep strength and a sufficiently high creep ductility in the high-temperature environment at 800° C. or more.

$$(W/184+Nb/93)/(C/12)\geq 5.5 \quad (1)$$

$$(W/184+Nb/93)/(B/11)\leq 450 \quad (2)$$

In Formulae (1) and (2), the content in mass % of the corresponding element is substituted for each symbol of element.

It is defined that F1=(W/184+Nb/93)/(C/12). If F1 is less than 5.5, the content of C is too much compared with the content of W and the content of Nb in the steel material. In this case, even if the content of C is 0.060% or less, W carbide and Nb carbide or the like are more likely to be produced than the Laves phase containing W and Nb during use in the high-temperature environment at 800° C. or more. Therefore, the amount of the Laves phase containing W and Nb produced is insufficient. As a result, the creep strength and the creep ductility in the high-temperature environment at 800° C. or more are low. If F1 is 5.5 or more, the Laves phase containing W and Nb is adequately produced in the high-temperature environment at 800° C. or more. Therefore, on the supposition that the contents of the elements in the chemical composition of the steel material fall within the ranges described above, Formula (2) is satisfied, and the sum of the content of dissolved Nb and the content of dissolved W is 3.2 mass % or more, if F1 is 5.5 or more, the creep strength and the creep ductility of the steel material in the high-temperature environment are increased.

It is defined that F2=(W/184+Nb/93)/(B/11). If F2 is more than 450, the content of B is too small with respect to the contents of W and Nb forming the Laves phase. In this case, the Laves phase containing W and Nb is not produced along the grain boundary and is likely to be produced in clusters. Therefore, during use in the high-temperature environment at 800° C. or more, the grain boundary is not adequately coated with the Laves phase, and the strengthening of the grain boundary is insufficient. As a result, the creep strength and the creep ductility of the steel material in the high-temperature environment at 800° C. or more are low. If F2 is 450 or less, during use in the high-temperature environment at 800° C. or more, the Laves phase containing W and Nb is produced along the grain boundary, and the grain boundary is adequately coated with the Laves phase. Therefore, on the supposition that the contents of the elements in the chemical composition of the steel material fall within the ranges according to this embodiment, Formula (1) is satisfied, and the sum of the content of dissolved Nb and the content of dissolved W is 3.2 mass % or more, if F2 is 450 or less, the creep strength and the creep ductility of the steel material in the high-temperature environment are increased.

[Sum of Content of Dissolved Nb and Content of Dissolved W]

On the supposition that the contents of the elements in the chemical composition of the steel material fall within the ranges described above, and Formulae (1) and (2) are satisfied, the sum of the content of dissolved Nb and the content of dissolved W is set to be 3.2 mass % or more. If the content of dissolved Nb and the content of dissolved W in the austenitic stainless steel material are high, the Laves phase containing W and Nb is likely to be formed in the steel material during use of the austenitic stainless steel material in the high-temperature environment at 800° C. or more. Furthermore, even if all W and Nb are not used to produce the Laves phase, if the remaining W and Nb are dissolved in the austenitic stainless steel material, the creep strength and the creep ductility are increased by solid-solution strengthening in the high-temperature environment at 800° C. or more. That is, if the amounts of dissolved Nb and W in the austenitic stainless steel material are increased, formation of the Laves phase containing W and Nb is promoted and the steel material is strengthened by solid-solution strengthening during use of the austenitic stainless steel material in the high-temperature environment at 800° C. or more.

If the sum of the content of dissolved Nb and the content of dissolved W is less than 3.2 mass %, the content of dissolved Nb and the content of dissolved W are too small. In this case, in the high-temperature environment at 800° C. or more, the Laves phase containing W and Nb is not adequately formed. In addition, the amounts of the dissolved Nb and dissolved W that contribute to the solid-solution strengthening are too small. Therefore, the creep strength and the creep ductility are low in the high-temperature environment at 800° C. or more. If the sum of the content of dissolved Nb and the content of dissolved W is 3.2 mass % or more, in the high-temperature environment at 800° C. or more, the Laves phase containing W and Nb is adequately formed, and the dissolved Nb and the dissolved W that are not used to form the Laves phase strengthens the steel material by solid-solution strengthening. Therefore, on the supposition that the contents of the elements in the chemical composition of the steel material fall within the ranges according to this embodiment, and Formulae (1) and (2) are satisfied, if the sum of the content of dissolved Nb and the content of dissolved W is 3.2 mass % or more, the creep strength and the creep ductility of the steel material in the high-temperature environment are increased.

The austenitic stainless steel material according to this embodiment is completed based on the technical concepts described above. The austenitic stainless steel material according to this embodiment is composed as described below.

[1] An austenitic stainless steel material including a chemical composition that consists of, in mass %.

C: 0.060% or less,
Si: 1.0% or less,
Mn: 2.00% or less,
P: 0.0010 to 0.0400%.
S: 0.010% or less,
Cr: 10 to 25%,
Ni: 25 to 45%,
Nb: 0.2 to 2.0%,
W: 2.5 to 6.0%,
B: 0.0010 to 0.0100%,
Al: 2.5 to 4.5%,
N: 0 to 0.030%,
Cu: 0 to 2.0%,
Ta: 0 to 3.0%,
Mo: 0 to 3.0%,
Ti: 0 to 0.20%,
V: 0 to 0.5%.
Hf: 0 to 0.10%, Zr: 0 to 0.20%, Ca: 0 to 0.008%, rare earth metal (REM): 0 to 0.10%, and the balance being Fe and impurities, and satisfies Formulae (1) and (2), wherein the sum of the content of dissolved Nb and the content of dissolved W is 3.2 mass % or more.

$$(W/184+Nb/93)/(C/12)\geq 5.5 \quad (1)$$

$$(W/184+Nb/93)/(B/11)\leq 450 \quad (2)$$

The content in mass % of the corresponding element is substituted for each symbol of element in Formulae (1) and (2).

[2] The austenitic stainless steel material according to [1], wherein the chemical composition contains one or more elements selected from a group consisting of:

Cu: 0.1 to 2.0%,

Ta: 0.1 to 3.0%,

Mo: 0.1 to 3.0%,

Ti: 0.01 to 0.20%, and

V: 0.1 to 0.5%.

[3] The austenitic stainless steel material according to [1] or [2], wherein the chemical composition contains one or more elements selected from a group consisting of:

Hf: 0.01 to 0.10%, and

Zr: 0.01 to 0.20%.

[4] The austenitic stainless steel material according to any one of [1] to [3], wherein the chemical composition contains one or more elements selected from a group consisting of:

Ca: 0.001 to 0.008%, and rare earth metal (REM): 0.01 to 0.10%.

In the following, the austenitic stainless steel material according to this embodiment will be described in detail. The symbol "%" used to indicate the content of an element means mass % unless otherwise specified.

[Chemical Composition]

The chemical composition of the austenitic stainless steel material according to this embodiment contains the elements described below.

C: 0.060% or Less

Carbon (C) is unavoidably contained. In other words, the content of C is more than 0%. C is likely to combine with Nb and W or the like to form a carbide. If Nb carbide or the like and W carbide are formed, the amount of the Laves phase containing W and Nb produced at the grain boundary decreases. Therefore, in the high-temperature environment at 800° C. or more, the creep strength and the creep ductility decrease. If the content of C is more than 0.060%, the creep strength and the creep ductility significantly decrease for this reason even if the contents of the other elements fall within the ranges according to this embodiment. For this reason, the content of C is 0.060% or less. An upper limit of the content of C is preferably 0.057%, more preferably 0.050%, and further preferably 0.030%. The content of C is preferably as low as possible. However, excessively reducing the content of C leads to an increase of the production cost. Therefore, from the viewpoint of industrial production, a lower limit of the content of Cis preferably 0.001%, and more preferably 0.002%.

Si: 1.0% or less

Silicon (Si) is unavoidably contained. In other words, the content of Si is more than 0%. Si deoxidizes the steel in the steelmaking process. Even a little Si contained in the steel material can exert this effect to some extent. However, if the content of Si is more than 1.0%, the hot workability of the steel material decreases even if the contents of the other elements fall within the ranges according to this embodiment. For this reason, the content of Si is 1.0% or less. A lower limit of the content of Si is preferably 0.1%, and more preferably 0.2%. An upper limit of the content of Si is preferably 0.9%, more preferably 0.8%, and further preferably 0.7%.

Mn: 2.00% or Less

Manganese (Mn) is unavoidably contained. In other words, the content of Mn is more than 0%. Mn combines with S in the steel material to form MnS, and increases the hot workability of the steel material. Even a little Mn contained in the steel material can exert this effect to some extent. However, if the content of Mn is more than 2.00%, the hardness of the steel material excessively increases, and the hot workability and the weldability of the steel material decrease even if the contents of the other elements fall within the ranges according to this embodiment. For this reason, the content of Mn is 2.00% or less. A lower limit of the content of Mn is preferably 0.01%, more preferably 0.10%, further preferably 0.20%, further preferably 0.30%, and further preferably 0.40%. An upper limit of the content of Mn is preferably 1.90%, more preferably 1.80%, further preferably 1.50%, further preferably 1.30%, further preferably 1.20%, and further preferably 1.00%.

P: 0.0010 to 0.0400%

Phosphorus (P) segregates at the grain boundary in the high-temperature environment and prevents segregation of S to the grain boundary. Therefore, phosphorus increases the creep strength. If the content of P is less than 0.0010%, this effect cannot be adequately achieved even if the contents of the other elements fall within the ranges according to this embodiment. On the other hand, if the content of P is more than 0.0400%, the hot workability and the weldability of the steel material decrease even if the contents of the other elements fall within the ranges according to this embodiment. For this reason, the content of P is 0.0010 to 0.0400%. A lower limit of the content of P is preferably 0.0020%, more preferably 0.0040%, and further preferably 0.0060%. An upper limit of the content of P is preferably 0.0380%, more preferably 0.0360%, and further preferably 0.0340%.

S: 0.010% or less

Sulfur (S) is unavoidably contained. In other words, the content of S is more than 0%. If the content of S is more than 0.010%, the hot workability and the creep ductility in the high-temperature environment of the steel material decrease even if the contents of the other elements fall within the ranges according to this embodiment. For this reason, the content of S is 0.010% or less. The content of S is preferably as low as possible. However, excessively reducing the content of S leads to an increase of the production cost. Therefore, from the viewpoint of the normal industrial production, a lower limit of the content of S is preferably 0.001%, and more preferably 0.002%.

Cr: 10 to 25%

Chromium (Cr) increases the oxidation resistance and the corrosion resistance of the steel material during use of the steel material in the high-temperature environment. If the content of Cr is less than 10%, this effect cannot be adequately achieved even if the contents of the other elements fall within the ranges according to this embodiment. On the other hand, if the content of Cr is more than 25%, Cr in the steel material combines with C from the atmospheric gas (hydrocarbon gas) of the high-temperature environment, so that an excessively large amount of Cr carbide is produced on the surface of the base metal, even if the contents of the other elements fall within the ranges according to this embodiment. In this case, formation of $Al_2O_3$ on the surface of the steel material is not adequately promoted, and the carburization resistance of the steel material decreases. For this reason, the content of Cr is 10 to 25%. A lower limit of the content of Cr is preferably 11%, more preferably 12%, further preferably 13%, and further preferably 14%. An upper limit of the content of Cr is preferably 24%, more preferably 23%, further preferably 22%, further preferably 21%, and further preferably 20%.

Ni: 25 to 45%

Nickel (Ni) stabilizes the austenite and increases the creep strength of the steel material in the high-temperature environment. Ni also increases the carburization resistance of the steel material. If the content of Ni is less than 25%, this effect cannot be adequately achieved even if the contents of the other elements fall within the ranges according to this embodiment. On the other hand, if the content of Ni is more than 45%, an excessively large amount of an intermetallic compound containing Al (such as γ' phase ($Ni_3Al$)) is produced, so that the hot workability of the steel material in the high-temperature environment decreases, even if the contents of the other elements fall within the ranges according to this embodiment. For this reason, the content of Ni is 25 to 45%. A lower limit of the content of Ni is preferably 26%, more preferably 27%, further preferably 28%, further preferably 29%, and further preferably 30%. An upper limit of the content of Ni is preferably 44%, more preferably 43%, further preferably 42%, further preferably 41%, and further preferably 40%.

Nb: 0.2 to 2.00%

Niobium (Nb) strengthens the steel material by solid-solution strengthening and increases the creep strength of the steel material during use of the steel material in the high-temperature environment. Nb also forms a Laves phase ($Fe_2(Nb, W)$) and increases the creep strength and the creep ductility of the steel material by precipitation strengthening in the high-temperature environment at 800° C. or more. If the content of Nb is less than 0.2%, these effects cannot be adequately achieved even if the contents of the other elements fall within the ranges according to this embodiment. On the other hand, if the content of Nb is more than 2.0%, the weldability decreases even if the contents of the other elements fall within the ranges according to this embodiment. Furthermore, if the content of Nb is more than 2.0%, an intermetallic compound, such as the Laves phase and the gamma double prime phase (γ" phase ($Ni_3Nb$)), is excessively produced, and the toughness of the steel material decreases even if the contents of the other elements fall within the ranges according to this embodiment. For this reason, the content of Nb is 0.2 to 2.0%. A lower limit of the content of Nb is preferably 0.3%, and more preferably 0.4%. An upper limit of the content of Nb is preferably 1.9%, more preferably 1.8%, and further preferably 1.7%.

W: 2.5 to 6.0%

Tungsten (W) strengthens the steel material by solid-solution strengthening and increases the creep strength of the steel material during use of the steel material in the high-temperature environment. W also forms a Laves phase ($Fe_2(Nb, W)$) and increases the creep strength and the creep ductility of the steel material by precipitation strengthening in the high-temperature environment at 800° C. or more. If the content of W is less than 2.5%, these effects cannot be adequately achieved even if the contents of the other elements fall within the ranges according to this embodiment. On the other hand, if the content of W is more than 6.0%, the hot workability of the steel material decreases even if the contents of the other elements fall within the ranges according to this embodiment. For this reason, the content of W is 2.5 to 6.0%. A lower limit of the content of W is preferably 2.8%, more preferably 3.0%, and further preferably 3.2%. An upper limit of the content of W is preferably 5.8%, more preferably 5.6%, and further preferably 5.4%.

B: 0.0010 to 0.0100%

Boron (B) segregates at the grain boundary and increases the strength of the grain boundary during use of the steel material in the high-temperature environment. B also prevents coarsening of the Laves phase containing W and Nb and promotes formation of the Laves phase along the grain boundary during use of the steel material in the high-temperature environment at 800° C. or more. As a result, the creep strength and the creep ductility of the steel material in the high-temperature environment at 800° C. or more are increased. If the content of B is less than 0.0010%, these effects cannot be adequately achieved even if the contents of the other elements fall within the ranges according to this embodiment. On the other hand, if the content of B is more than 0.0100%, the weldability and the hot workability of the steel material decrease even if the contents of the other elements fall within the ranges according to this embodiment. For this reason, the content of B is 0.0010 to 0.0100%. A lower limit of the content of B is preferably 0.0011%, more preferably 0.0012%, further preferably 0.0014%, and further preferably 0.0018%. An upper limit of the content of B is preferably 0.0095%, more preferably 0.0090%, and further preferably 0.0085%.

Al: 2.5 to 4.5%

Aluminum (Al) forms an $Al_2O_3$ coating primarily made of $Al_2O_3$ on the surface of the steel material during use of the steel material in the high-temperature environment. $Al_2O_3$ is more thermodynamically stable than $Cr_2O_3$. Therefore, if an $Al_2O_3$ coating, rather than an oxide coating primarily made of $Cr_2O_3$, is formed on the surface of the steel material in the high-temperature environment, the oxidation resistance and the carburization resistance of the steel material are increased. If the content of Al is less than 2.5%, this effect cannot be adequately achieved even if the contents of the other elements fall within the ranges according to this embodiment. On the other hand, if the content of Al is more than 4.5%, an excessively large amount of a coarse intermetallic compound containing Al (for example γ' phase ($Ni_3Al$)) is produced during the production process, and the hot workability of the steel material decreases, even if the contents of the other elements fall within the ranges according to this embodiment. For this reason, the content of Al is 2.5 to 4.5%. A lower limit of the content of Al is preferably 2.6%, more preferably 2.7%, and further preferably 2.8%. An upper limit of the content of Al is preferably 4.3%, more preferably 4.1%, and further preferably 3.9%. In the chemical composition of the austenitic stainless steel material according to this embodiment, the content of Al means the total amount of Al (total content of Al) contained in the austenitic stainless steel material.

The balance of the chemical composition of the austenitic stainless steel material according to this embodiment is formed from Fe and impurities. The term "impurity" means a substance from an ore as a raw material, scrap or the production environment that is introduced during industrial production of the austenitic stainless steel material and is allowable since the impurity does not adversely affect the austenitic stainless steel material according to this embodiment.

[Optional Elements]

Furthermore, the austenitic stainless steel material according to this embodiment may further contain N as a replacement of part of Fe.

N: 0 to 0.030%

Nitrogen (N) is an optional element and may not be contained. In other words, the content of N may be 0%. If N is contained, or in other words, if the content of N is more than 0%, N stabilizes the austenite. Even a little N contained can exert this effect to some extent. However, if the content of N is more than 0.030%, N combines with Al to form AlN at the grain boundary or in the vicinity of the grain boundary. The AlN formed at the grain boundary or in the vicinity of the grain boundary decrease the hot workability of the steel material. For this reason, the content of N is 0 to 0.030%. A lower limit of the content of Nis preferably 0.001%, and more preferably 0.002%. An upper limit of the content of N is preferably 0.025%, more preferably 0.022%, and further preferably 0.020%.

Furthermore, the austenitic stainless steel material according to this embodiment may further contain one or more elements selected from a group consisting of Cu, Ta, Mo, Ti and V, as a replacement of part of Fe. These elements are optional elements. These elements further increase the creep strength of the steel material in the high-temperature environment at 800° C. or more.

Cu: 0 to 2.0%

Copper (Cu) is an optional element and may not be contained. In other words, the content of Cu may be 0%. If Cu is contained, or in other words, if the content of Cu is more than 0%, Cu further increases, by precipitation strengthening, the strength of the steel material at normal temperature and the creep strength of the steel material in the high-temperature environment at 800° C. or more. Even a little Cu contained can exert this effect to some extent. However, if the content of Cu is more than 2.0%, the ductility and the hot workability of the steel material decrease even if the contents of the other elements fall within the ranges according to this embodiment. For this reason, the content of Cu is 0 to 2.0%. A lower limit of the content of Cu is preferably 0.1%, more preferably 0.2%, and further preferably 0.5%. An upper limit of the content of Cu is preferably 1.9%, and more preferably 1.8%.

Ta: 0 to 3.0%

Tantalum (Ta) is an optional element and may not be contained. In other words, the content of Ta may be 0%. If Ta is contained, or in other words, if the content of Ta is more than 0%. Ta dissolves into the Laves phase to increase the amount of the Laves phase produced, and further increases the creep strength and the creep ductility of the steel material in the high-temperature environment at 800° C. or more. Even a little Ta contained can exert this effect to some extent. However, if the content of Ta is more than 3.0%, the hot workability of the steel material decreases even if the contents of the other elements fall within the ranges according to this embodiment. For this reason, the content of Ta is 0 to 3.0%. A lower limit of the content of Ta is preferably 0.1%, more preferably 0.2%, and further preferably 0.5%. An upper limit of the content of Ta is preferably 2.9%, and more preferably 2.8%.

Mo: 0 to 3.0%

Molybdenum (Mo) is an optional element and may not be contained. In other words, the content of Mo may be 0%. If Mo is contained, or in other words, if the content of Mo is more than 0%, Mo dissolves into the austenite, which is the base phase, and further increases, by solid-solution strengthening, the creep strength of the steel material in the high-temperature environment at 800° C. or more. Even a little Mo contained can exert this effect to some extent. However, if the content of Mo is more than 3.0%, the hot workability of the steel material decreases even if the contents of the other elements fall within the ranges according to this embodiment. For this reason, the content of Mo is 0 to 3.0%. A lower limit of the content of Mo is preferably 0.1%, more preferably 0.5%, and further preferably 0.7%. An upper limit of the content of Mo is preferably 2.5%, more preferably 2.2%, and further preferably 2.0%.

Ti: 0 to 0.20%

Titanium (Ti) is an optional element and may not be contained. In other words, the content of Ti may be 0%. If Ti is contained, or in other words, if the content of Ti is more than 0%. Ti forms a Laves phase and further increases the creep strength and the creep ductility of the steel material by precipitation strengthening during use of the steel material in the high-temperature environment at 800° C. or more. Even a little Ti contained can exert this effect to some extent. However, if the content of Ti is more than 0.20%, an excessively large amount of an intermetallic compound, such as the Laves phase, is produced, the creep ductility of the steel material in the high-temperature environment decreases, and the hot workability of the steel material decreases even if the contents of the other elements fall within the ranges according to this embodiment. For this reason, the content of Ti is 0 to 0.20%. A lower limit of the content of Ti is preferably 0.01%, more preferably 0.02%, and further preferably 0.03%. An upper limit of the content of Ti is preferably 0.18%, more preferably 0.15%, and further preferably 0.12%.

V: 0 to 0.5%

Vanadium (V) is an optional element and may not be contained. In other words, the content of V may be 0%. If V is contained, or in other words, if the content of V is more than 0%. V forms a Laves phase and further increases the creep strength and the creep ductility of the steel material by precipitation strengthening during use of the steel material in the high-temperature environment at 800° C. or more. Even a little V contained can exert this effect to some extent. However, if the content of V is more than 0.5%, the hot workability of the steel material decreases even if the contents of the other elements fall within the ranges according to this embodiment. For this reason, the content of V is 0 to 0.5%. A lower limit of the content of V is preferably 0.1%. An upper limit of the content of V is preferably 0.4%, and more preferably 0.3%.

Furthermore, the austenitic stainless steel material according to this embodiment may further contain one or more elements selected from a group consisting of Hf and Zr as a replacement of part of Fe. These elements are optional elements. These elements promote formation of an $Al_2O_3$ coating on the surface of the steel material in the high-temperature environment and increases the oxidation resistance and the carburization resistance of the steel material.

Hf: 0 to 0.10%

Hafnium (Hf) is an optional element and may not be contained. In other words, the content of Hf may be 0%. If Hf is contained, or in other words, if the content of Hf is more than 0%. Hf promotes formation of an $Al_2O_3$ coating on the surface of the steel material and increases the oxidation resistance and the carburization resistance of the steel material during production of the steel material and/or during use of the steel material in the high-temperature environment. Even a little Hf contained can exert this effect to some extent. However, if the content of Hf is more than 0.10%, an intermetallic compound is excessively formed in the steel material, and the hot workability of the steel material decreases, even if the contents of the other elements fall within the ranges according to this embodiment. For this reason, the content of Hf is 0 to 0.10%. A lower limit of the content of Hf is preferably 0.01%, more preferably 0.02%, and further preferably 0.03%. An upper limit of the content of Hf is preferably 0.09%, more preferably 0.08%, and further preferably 0.07%.

Zr: 0 to 0.20%

Zirconium (Zr) is an optional element and may not be contained. In other words, the content of Zr may be 0%. If Zr is contained, or in other words, if the content of Zr is more than 0%, Zr promotes formation of an $Al_2O_3$ coating on the surface of the steel material and increases the oxidation resistance and the carburization resistance of the steel material during production of the steel material and/or during use of the steel material in the high-temperature environment. Even a little Zr contained can exert this effect to some extent. However, if the content of Zr is more than 0.20%, an intermetallic compound is excessively formed in the steel material, and the hot workability of the steel material decreases, even if the contents of the other elements fall within the ranges according to this embodiment. For this reason, the content of Zr is 0 to 0.20%. A lower limit of the content of Zr is preferably 0.01%, more preferably 0.02%, and further preferably 0.03%. An upper limit of the content of Zr is preferably 0.17%, more preferably 0.15%, and further preferably 0.12%.

Furthermore, the austenitic stainless steel material according to this embodiment may further contain one or more elements selected from a group consisting of Ca and rare earth metals (REMs) as a replacement of part of Fe. These elements are optional elements. These elements increase the hot workability of the steel material.

Ca: 0 to 0.008%

Calcium (Ca) is an optional element and may not be contained. In other words, the content of Ca may be 0%. If Ca is contained, or in other words, if the content of Ca is more than 0%, Ca fixes S in the form of a sulfide. This increases the hot workability of the steel material. Even a little Ca contained can exert this effect to some extent. However, if the content of Ca is more than 0.008%, the toughness and the hot workability of the steel material decrease even if the contents of the other elements fall within the ranges according to this embodiment. For this reason, the content of Ca is 0 to 0.008%. A lower limit of the content of Ca is preferably 0.001%, more preferably 0.002%, and further preferably 0.003%. An upper limit of the content of Ca is preferably 0.007%.

Rare earth metal (REM): 0 to 0.10%

Rare earth metal (REM) is an optional element and may not be contained. In other words, the content of REM may be 0%. If REM is contained, or in other words, if the content of REM is more than 0%, REM combines with S to form a sulfate to fix S. This increases the hot workability of the steel material. The fixation of S reduces the interface segregation of S, so that the corrosion resistance of the steel material increases. Even a little REM contained can exert this effect to some extent. However, if the content of REM is more than 0.10%, the amount of an inclusion, such as an oxide, excessively increases, and the hot workability and the weldability of the steel material decrease. For this reason, the content of REM is 0 to 0.10%. A lower limit of the content of REM is preferably 0.01%, more preferably 0.03%, and further preferably 0.05%. An upper limit of the content of REM is preferably 0.09%, more preferably 0.08%, and further preferably 0.07%.

In this specification, the term "REM" generically refers to a total of 17 elements including Sc, Y and lanthanoids. If the REM contained in the austenitic stainless steel material according to this embodiment is one of these elements, the "content of REM" means the content of the contained element. If the austenitic stainless steel material according to this embodiment contains two or more kinds of REMs, the "content of REM" means the total content of the elements. In general, REM is contained in a mischmetal.

[Formulae (1) and (2)]

The chemical composition of the austenitic stainless steel material according to this embodiment satisfies the following Formulae (1) and (2).

$$(W/184+Nb/93)/(C/12)\geq 5.5 \quad (1)$$

$$(W/184+Nb/93)/(B/11)\leq 450 \quad (2)$$

In Formulae (1) and (2), the content in mass % of the corresponding element is substituted for each symbol of element.

[Formula (1)]

It is defined that F1=(W/184+Nb/93)/(C/12). F1 is an index of the amount of the Laves phase produced during use of the steel material in the high-temperature environment. If F1 is less than 5.5, the content of C is too much compared with the content of W and the content of Nb in the steel material. In this case, in the steel material being used in the high-temperature environment at 800° C. or more, more W carbide and Nb carbide or the like are excessively produced than the Laves phase containing W and Nb. Therefore, the amount of the Laves phase produced at the grain boundary is too small. As a result, the creep strength and the creep ductility of the steel material in the high-temperature environment at 800° C. or more are low. If F1 is 5.5 or more, the Laves phase containing W and Nb is adequately produced in the steel material being used in the high-temperature environment at 800° C. or more. Therefore, on the supposition that the contents of the elements in the chemical composition of the steel material fall within the ranges according to this embodiment, and the steel material satisfies Formula (2), if F1 is 5.5 or more, the creep strength and the creep ductility of the steel material in the high-temperature environment at 800° C. or more are increased. A lower limit of F1 is preferably 6.0, more preferably 6.5, further preferably 7.0, and further preferably 7.5. The upper limit of F1 is not particularly limited but is 649.0, for example.

[Formula (2)]

It is defined that F2=(W/184+Nb/93)/(B/11). F2 is an index of the rate of coating of the grain boundary of the Laves phase. If F2 is more than 450, the content of B is too small with respect to the contents of W and Nb forming the Laves phase. In this case, the Laves phase containing W and Nb is not formed along the grain boundary but is formed in clusters in the steel material being used in the high-temperature environment at 800° C. or more. Therefore, the grain boundary is difficult to adequately coat with the Laves phase containing W and Nb. As a result, the creep strength and the creep ductility of the steel material in the high-temperature environment at 800° C. or more are low. If F2 is 450 or less, the content of B is sufficiently high with respect to the contents of W and Nb forming the Laves phase. In this case, in the steel material being used in the high-temperature environment at 800° C. or more, B that segregates at the grain boundary promotes formation of the Laves phase containing W and Nb, so that the Laves phase containing W and Nb is formed along the grain boundary, and the grain boundary is adequately coated with the Laves phase containing W and Nb. As a result, the creep strength and the creep ductility of the steel material in the high-temperature environment at 800° C. or more are increased. An upper limit of F2 is preferably 420, more preferably 400, further preferably 350, further preferably 300, and further preferably 290. The lower limit of F2 is not particularly limited but is 17, for example.

[Method of Chemical Composition Analysis of Austenitic Stainless Steel Material]

The chemical composition of the austenitic stainless steel material according to this embodiment can be determined in a well-known composition analysis method. Specifically, when the austenitic stainless steel material is a pipe, the pipe is pierced with a drill at a midpoint of the wall thickness of the pipe to produce machined chips, and the machined chips are collected. When the austenitic stainless steel material is a steel plate, the plate is pierced with a drill at a midpoint of the plate width and at a midpoint of the plate thickness to produce machined chips, and the machined chips are collected. When the austenitic stainless steel material is a steel bar, the bar is pierced with a drill at an R/2 point to produce machined chips, and the machined chips are collected. The term "R/2 point" means a central point of the radius R in the cross section perpendicular to the longitudinal direction of the steel bar.

The collected machined chips are dissolved in an acid to produce a solution. Inductively coupled plasma atomic emission spectrometry (ICP-AES) is performed on the solution to analyze the elements of the chemical composition. The content of C and the content of S are determined in the well-known high-frequency combustion method (combustion-infrared absorption method). The content of N is determined in the well-known inert gas fusion-thermal conductivity method.

[Sum of Content of Dissolved Nb and Content of Dissolved W]

With the austenitic stainless steel material according to this embodiment, the contents of the elements in the chemical composition falls within the ranges according to this embodiment, Formulae (1) and (2) are satisfied, and the sum of the content of dissolved Nb and the content of dissolved W is 3.2 mass % or more.

If W and Nb are sufficiently dissolved, formation of the Laves phase containing W and Nb is promoted during use in the high-temperature environment. If the sum of the content of dissolved Nb and the content of dissolved W is less than 3.2 mass %, the amounts of dissolved Nb and dissolved W are too small. In this case, in the high-temperature environment at 800° C. or more, the Laves phase containing W and Nb is not adequately formed. In addition, the amounts of dissolved Nb and dissolved W that contribute to the solid-solution strengthening are too small. Therefore, the creep strength and the creep ductility decrease in the high-temperature environment at 800° C. or more.

If the sum of the content of dissolved Nb and the content of dissolved W is 3.2 mass % or more, in the high-temperature environment at 800° C. or more, the Laves phase containing W and Nb is adequately formed, and within the grain and the grain boundary of the steel material are strengthened by precipitation strengthening by the Laves phase. In addition, the dissolved Nb and the dissolved W that are not contained in the Laves phase strengthen the steel material by solid-solution strengthening. Therefore, the creep strength and the creep ductility of the steel material in the high-temperature environment at 800° C. or more are increased. The lower limit of the sum of the content of dissolved Nb and the content of dissolved W is more preferably 3.4 mass %, even more preferably 3.7 mass %, and even more preferably 3.8 mass %. The upper limit of the sum of the content of dissolved Nb and the content of dissolved W is not particularly limited but is 7.9 mass %, for example.

[Method of Measuring Content of Dissolved Nb and Content of Dissolved W]

The content of dissolved Nb and the content of dissolved W are determined in the extraction residue method. Specifically, a test specimen is taken from the austenitic stainless steel material. The cross section of the test specimen perpendicular to the longitudinal direction thereof may be circular or rectangular. When the austenitic stainless steel material is a pipe, the test specimen is taken in such a manner that the center of the cross section of the test specimen perpendicular to the longitudinal direction thereof coincides with the midpoint of the wall thickness of the pipe, and the longitudinal direction of the test specimen coincides with the longitudinal direction of the pipe. When the austenitic stainless steel material is a steel plate, the test specimen is taken in such a manner that the center of the cross section of the test specimen perpendicular to the longitudinal direction thereof coincides with the midpoint of the plate width and the midpoint of the plate thickness of the steel plate, and the longitudinal direction of the test specimen coincides with the longitudinal direction of the steel plate. When the austenitic stainless steel material is a steel bar, the test specimen is taken in such a manner that the center of the cross section of the test specimen perpendicular to the longitudinal direction thereof coincides with the R/2 point of the steel bar, and the longitudinal direction of the test specimen coincides with the longitudinal direction of the steel bar.

The surface of the taken test specimen is ground by preliminary electrolytic grinding to remove about 50 μm of the surface and produce a fresh surface. The electrolytically ground test specimen is electrolyzed (final electrolyzation) in an electrolyte (10% of acetylacetone, 1% of tetraammonium, and methanol). The electrolyte after the final electrolyzation is filtered through a 0.2 μm filter to trap a residue. The obtained residue is decomposed in an acid, and the mass of Nb in the residue and the mass of W in the residue are determined by ICP (inductively coupled plasma). Furthermore, the mass of the finally electrolyzed base metal (austenitic stainless steel material) is determined. Specifically, the mass of the test specimen before the final electrolyzation and the mass of the test specimen after the final electrolyzation are measured. Then, the difference obtained by subtracting the mass of the test specimen after the final electrolyzation from the mass of the test specimen before the final electrolyzation is defined as the mass of the finally electrolyzed base metal.

The mass of Nb in the residue is divided by the mass of the finally electrolyzed base metal, and the quotient is subtracted from the content of Nb in the chemical composition of the austenitic stainless steel material. That is, the content of dissolved Nb is determined according to the following Formula (i). On the other hand, the mass of W in the residue is divided by the mass of the finally electrolyzed base metal, and the quotient is subtracted from the content of W in the chemical composition of the austenitic stainless steel material. That is, the content of dissolved W is determined according to the following Formula (ii). The determined content of dissolved Nb and the determined content of dissolved W are summed to determine the sum of the content of dissolved Nb and the content of dissolved W.

content of dissolved Nb=content of Nb in chemical composition (mass %)−(mass of Nb in residue)/(mass of base metal)×100 (i)

content of dissolved W=content of W in chemical composition (mass %)−(mass of W in residue)/(mass of base metal)×100 (ii)

[Shape of Austenitic Stainless Steel Material According to Embodiment]

The shape of the austenitic stainless steel material according to this embodiment is not particularly limited. The austenitic stainless steel material according to this embodiment may be a pipe, a steel plate, or a steel bar. The austenitic stainless steel material according to this embodiment may be a forged product.

[Use of Austenitic Stainless Steel Material According to Embodiment]

The austenitic stainless steel material according to this embodiment is suitable for use for an apparatus that is used in a high-temperature environment at 800° C. or more. Such an apparatus is an apparatus in a chemical plant facility for petroleum refining or petrochemical processing in a high-temperature environment in which an atmosphere containing a chemical material containing carbon is at 800° C. or more, for example. Such a chemical plant is an ethylene producing plant, for example. Note that the austenitic stainless steel material according to this embodiment can also be used for an apparatus used in a high-temperature environment at a temperature less than 800° C.

Note that, of course, the austenitic stainless steel material according to this embodiment can also be used in other facilities than the chemical plant facilities. The other facilities than the chemical plant facilities include a thermal power generation boiler facility (such as a boiler tube) that is supposed to be used in a high-temperature environment at 800° C. or more as with the chemical plant facilities.

[Method of Producing Austenitic Stainless Steel Material According to Embodiment]

In the following, a method of producing the austenitic stainless steel material according to this embodiment will be described, the method of producing the austenitic stainless steel material described below is an example of the method of producing the austenitic stainless steel material according to this embodiment. That is, the austenitic stainless steel material having the composition described above can also be produced in other production methods than the production method described below. However, the production method described below is a preferred example of the method of producing the austenitic stainless steel material according to this embodiment.

A method of producing the austenitic stainless steel material according to this embodiment includes a step of preparing a starting material (preparation step), a step of performing hot working on the starting material to produce an intermediate steel material (hot working step), a step of performing cold working after performing a pickling treatment on the intermediate steel material subjected to the hot working as required (cold working step), and a step of performing a solution treatment on the intermediate steel material subjected to the cold working (solution treatment step). In the following, each step will be described.

[Preparation Step]

In the preparation step, the starting material having the chemical composition described above is prepared. The starting material may be supplied from a third party or may be produced. The starting material may be an ingot, a slab, a bloom, or a billet. When producing the starting material, the starting material is produced in the following manner. A molten steel having the chemical composition described above is produced. For example, an electric furnace, an argon oxygen decarburization (AOD) furnace, or a vacuum oxygen decarburization (VOD) furnace is used to produce the molten steel in a well-known manner. Using the produced molten steel, an ingot is produced in an ingot-making process. Using the produced molten steel, a slab, a bloom, or a billet (cylindrical starting material) may be produced in a continuous casting process. A hot working may be performed on the produced ingot, slab or bloom to produce a billet. For example, hot forging may be performed on the ingot to produce a cylindrical billet, and the billet may be used as a starting material (cylindrical starting material). In that case, the temperature of the starting material immediately before start of the hot forging is not particularly limited but is 1000 to 1300° C., for example. The method of cooling the starting material subjected to the hot forging is not particularly limited.

[Hot Working Step]

In the hot working step, hot working is performed on the starting material prepared in the preparation step to produce an intermediate steel material. The intermediate steel material may be a pipe, a steel plate, or a steel bar, for example.

When the intermediate steel material is a pipe, the following working is performed in the hot working step. First, a cylindrical starting material is prepared. A through-hole is formed in the cylindrical starting material along the central axis thereof by machining. Hot extrusion, such as the Ugine Sejournet process, is performed on the cylindrical starting material with the through-hole to produce an intermediate steel material (pipe). The temperature of the starting material immediately before the hot extrusion is not particularly limited. The temperature of the starting material immediately before the hot extrusion is 1000 to 1300° C., for example. Instead of the hot extrusion process, the hot punching pipe-making process may be performed.

Instead of the hot extrusion, piercing-rolling according to the Mannesmann pipe making process may be performed to produce a pipe. In that case, a round billet is pierced and rolled with a piercing machine. In the piercing-rolling, the piercing ratio is not particularly limited but is 1.0 to 4.0, for example. The pierced and rolled round billet is further hot-rolled with a mandrel mill, a reducer, a sizing mill or the like to produce a hollow shell. The cumulative reduction of area in the hot working step is not particularly limited but is 20 to 80%, for example. The temperature of the starting material immediately before the piercing-rolling is 1000 to 1300° C., for example.

When the intermediate steel material is a steel plate, one or more rollers including a pair of work rolls are used in the hot working step, for example. Hot rolling is performed on the starting material, such as a slab, with the rollers to produce a steel plate. The starting material is heated before the hot rolling. The hot rolling is performed on the heated starting material. The temperature of the starting material immediately before the hot rolling is 1000 to 1300° C., for example.

When the intermediate steel material is a steel bar, the hot working step includes a rough rolling step and a finish rolling step, for example. In the rough rolling step, hot working is performed on the starting material to produce a billet. In the rough rolling step, a blooming machine is used, for example. Specifically, blooming is performed on the starting material with a blooming machine to produce a billet. If a continuous mill is arranged downstream of the blooming machine, the continuous mill may be used to further perform hot rolling on the billet subjected to the blooming to produce a smaller billet. In the continuous mill, for example, horizontal stands having a pair of horizontal rolls and vertical stands having a pair of vertical rolls are alternately arranged in a row. In the rough rolling step, a billet is produced from the starting material, such as a bloom. The temperature of the starting material immediately before the rough rolling step is not particularly limited but is 1000 to 1300° C., for example. In the finish rolling step, the billet is first heated. Hot rolling is performed on the heated billet with a continuous mill to produce a steel bar. The heating temperature in the heating furnace in the finish rolling step is not particularly limited but is 1000 to 1300° C., for example.

[Cold Working Step]

The cold working step is performed as required. In other words, the cold working step may not be performed. When performing the cold working step, cold working is performed on the intermediate steel material after a pickling treatment is performed on the intermediate steel material. When the intermediate steel material is a pipe or a steel bar, the cold working is cold drawing, for example. When the intermediate steel material is a steel plate, the cold working is cold rolling, for example. By performing the cold working step, a distortion is imparted to the intermediate steel material before the solution treatment step. This allows development of recrystallization and homogeneous microstructure in the solution treatment step. The reduction of area in the cold working step is not particularly limited but is 10 to 90%, for example.

[Solution Treatment Step]

In the solution treatment step, a solution treatment is performed on the intermediate steel material subjected to the hot working step or the cold working step. The solution treatment is performed in the following manner. The intermediate steel material is placed in a heat treatment furnace. In the air atmosphere in the furnace, the intermediate steel material is kept at a solution treatment temperature T(° C.) and then rapidly cooled.

The solution treatment temperature T can fall within the well-known temperature range. For example, the solution treatment temperature T is 1150 to 1280° C. A retention time t of the solution treatment temperature is 1 to 60 minutes, for example.

Provided that the solution treatment temperature T and the retention time t of the solution treatment temperature T fall within the ranges described above, the solution treatment further satisfies the following Formula (iii).

$$T\times\{t^{(1/3)}+(Nb/93+W/184)\times 50\}/100\geq 25 \quad \text{(iii)}$$

"Nb" in Formula (iii) means the content (mass %) of Nb in the chemical composition of the austenitic stainless steel material. "W" means the content (mass %) of W in the chemical composition of the austenitic stainless steel material. "T" means the solution treatment temperature T (C). "t" means the retention time t (minutes) at the solution treatment temperature T (° C.).

It is defined that $F3=T\times(t^{(1/3)}+(Nb/93+W/184)\times 50)/100$. Depending on the contents of Nb and W in the chemical composition of the austenitic stainless steel material, the conditions for the solution treatment are appropriately set to increase the content of dissolved Nb and the content of dissolved W. If F3 is less than 25, the sum of the content of dissolved Nb and the content of dissolved W in the austenitic stainless steel material is less than 3.2 mass %. In that case, in the high-temperature environment at 800° C. or more, the creep strength and the creep ductility of the austenitic stainless steel material decrease.

In the process described above, the austenitic stainless steel material according to this embodiment can be produced. The production method described above is an example of the method of producing the austenitic stainless steel material according to this embodiment. Therefore, the method of producing the austenitic stainless steel material according to this embodiment is not limited to the production method described above.

As described above, the austenitic stainless steel material according to this embodiment has the chemical composition described above and satisfies Formulae (1) and (2). Furthermore, the sum of the content of dissolved Nb and the content of dissolved W in the steel material is 3.2 mass % or more. As a result, the austenitic stainless steel material according to this embodiment has a high creep strength and a high creep ductility when the austenitic stainless steel material is used in the high-temperature environment at 800° C. or more.

EXAMPLES

[Production of Austenitic Stainless Steel Material]

Molten steels having the chemical compositions shown in Table 1 were produced.

TABLE 1

| Test | Chemical composition (in mass %, the balance being Fe and impunties) | | | | | | | | | | | | | |
|---|---|---|---|---|---|---|---|---|---|---|---|---|---|---|
| number | C | Si | Mn | P | S | Cr | Ni | Nb | W | B | Al | Optional elements | F1 | F2 |
| 1 | 0.025 | 0.9 | 0.22 | 0.0330 | 0.004 | 18 | 43 | 1.4 | 4.7 | 0.0032 | 2.8 | | 19.5 | 140 |
| 2 | 0.003 | 0.2 | 1.24 | 0.0350 | 0.005 | 15 | 41 | 0.2 | 5.0 | 0.0028 | 3.0 | | 117.3 | 115 |
| 3 | 0.017 | 0.4 | 0.10 | 0.0400 | 0.009 | 23 | 30 | 0.4 | 3.6 | 0.0041 | 3.8 | | 16.8 | 64 |
| 4 | 0.047 | 0.3 | 1.12 | 0.0360 | 0.001 | 18 | 36 | 1.4 | 5.7 | 0.0090 | 2.5 | Ca: 0.003 Mo: 1.6 | 11.8 | 56 |
| 5 | 0.023 | 0.9 | 0.90 | 0.0120 | 0.003 | 14 | 38 | 1.2 | 4.0 | 0.0055 | 3.0 | REM: 0.07 | 18.1 | 69 |
| 6 | 0.018 | 0.5 | 1.71 | 0.0210 | 0.008 | 22 | 34 | 1.3 | 4.2 | 0.0029 | 3.9 | Ca: 0.006 Ta: 1.9 V: 0.1 | 24.5 | 140 |
| 7 | 0.027 | 0.3 | 0.70 | 0.0160 | 0.007 | 23 | 38 | 1.8 | 3.0 | 0.0014 | 4.0 | N: 0.016 Ti: 0.06 | 15.8 | 280 |
| 8 | 0.056 | 0.6 | 1.28 | 0.0040 | 0.006 | 14 | 35 | 1.1 | 3.5 | 0.0012 | 3.5 | Cu: 1.8 | 6.6 | 283 |
| 9 | 0.010 | 0.4 | 1.83 | 0.0070 | 0.008 | 19 | 29 | 1.7 | 4.5 | 0.0057 | 2.7 | N: 0.008 Zr: 0.05 | 51.3 | 82 |
| 10 | 0.002 | 0.9 | 1.75 | 0.0370 | 0.007 | 24 | 30 | 0.5 | 4.0 | 0.0029 | 2.5 | Hf: 0.04 | 162.7 | 103 |
| 11 | 0.027 | 0.3 | 0.70 | 0.0160 | 0.007 | 23 | 38 | 1.7 | 4.1 | 0.0011 | 4.0 | | 18.0 | 406 |
| 12 | 0.058 | 0.6 | 1.28 | 0.0040 | 0.006 | 14 | 35 | 0.9 | 3.7 | 0.0012 | 3.5 | | 6.2 | 273 |
| 13 | 0.052 | 0.2 | 0.98 | 0.0070 | 0.001 | 24 | 35 | 0.6 | 3.2 | 0.0022 | 2.6 | | 5.5 | 119 |
| 14 | 0.098 | 0.5 | 0.83 | 0.0270 | 0.010 | 23 | 33 | 1.7 | 5.0 | 0.0040 | 4.1 | | 5.6 | 125 |
| 15 | 0.042 | 0.1 | 1.03 | 0.0330 | 0.006 | 18 | 28 | 1.2 | 1.6 | 0.0081 | 3.5 | | 6.2 | 29 |

TABLE 1-continued

| Test number | Chemical composition (in mass %, the balance being Fe and impunties) C | Si | Mn | P | S | Cr | Ni | Nb | W | B | Al | Optional elements | F1 | F2 |
|---|---|---|---|---|---|---|---|---|---|---|---|---|---|---|
| 16 | 0.031 | 0.3 | 1.87 | 0.0080 | 0.000 | 11 | 30 | 1.9 | 2.2 | 0.0008 | 2.8 | | 12.5 | 445 |
| 17 | 0.034 | 0.8 | 0.50 | 0.0005 | 0.010 | 20 | 29 | 0.4 | 5.4 | 0.0049 | 3.1 | | 11.9 | 76 |
| 18 | 0.044 | 0.6 | 0.90 | 0.0280 | 0.006 | 16 | 42 | 0.1 | 4.9 | 0.0075 | 4.0 | | 7.6 | 41 |
| 19 | 0.056 | 0.1 | 0.97 | 0.0350 | 0.001 | 10 | 26 | 0.2 | 3.0 | 0.0012 | 2.7 | | 4.0 | 169 |
| 20 | 0.019 | 0.6 | 0.26 | 0.0220 | 0.007 | 19 | 31 | 1.8 | 5.2 | 0.0010 | 3.7 | | 30.1 | 524 |
| 21 | 0.037 | 0.9 | 0.95 | 0.0210 | 0.007 | 21 | 39 | 1.7 | 5.7 | 0.0011 | 2.8 | | 16.0 | 493 |
| 22 | 0.040 | 0.5 | 1.05 | 0.0330 | 0.001 | 20 | 40 | 0.5 | 3.0 | 0.0015 | 3.1 | | 6.5 | 159 |

An ingot having an outer diameter of 120 mm and a weight of 30 kg was produced from the molten steel. Hot forging was performed on the ingot to produce a steel plate having a thickness of 30 mm. The temperature of the ingot before the hot forging was 1250° C. Furthermore, hot rolling was performed on the steel plate to produce a steel plate (intermediate steel material) having a thickness of 15 mm. The temperature of the steel plate before the hot working (hot rolling) fell within the range of 1050 to 1250° C. Cold rolling was performed on the intermediate steel material (steel plate) subjected to the hot rolling to produce a steel plate having a thickness of 10.5 mm and a width of 80 mm. A solution treatment was performed on the intermediate steel material subjected to the cold rolling at the solution treatment temperature T (° C.) for the retention time t (minutes) specified in Table 2. Table 2 also shows the value of F3 in the solution treatment. Water-cooling was performed on the intermediate steel material kept at the solution treatment temperature T for the retention time t. In the process described above, the austenitic stainless steel material (steel plate) of each test number was produced.

[Chemical Composition Analysis of Steel Material]

The chemical composition of the austenitic stainless steel material (steel plate) of each test number was determined in the following manner. The steel material (steel plate) was pierced with a drill at a midpoint of the plate width and at a midpoint of the plate thickness to produce machined chips, and the machined chips were collected. The collected machined chips were dissolved in an acid to produce a solution. ICP-AES was performed on the solution to analyze the elements of the chemical composition. The content of C and the content of S were determined in the well-known high-frequency combustion method (combustion-infrared absorption method). The content of N was determined in the well-known inert gas fusion-thermal conductivity method. The chemical composition of the steel material of each test number was as shown in Table 1.

[Measurement of Content of Dissolved Nb and Content of Dissolved W]

The content of dissolved Nb and the content of dissolved W were determined in the extraction residue method. A test specimen was taken from the austenitic stainless steel material (steel plate) of each test number. The test specimen was taken in such a manner that the center of the cross section of the test specimen perpendicular to the longitudinal direction thereof coincided with the midpoint of the plate width and the midpoint of the plate thickness of the austenitic stainless steel material (steel plate), and the longitudinal direction of the test specimen coincided with the longitudinal direction of the austenitic stainless steel material (steel plate). The surface of the taken test specimen was ground by preliminary electrolytic grinding to remove about 50 μm of the surface and produce a fresh surface. The electrolytically ground test specimen was electrolyzed (final electrolyzation) in an electrolyte (10% of acetylacetone, 1% of tetraammonium, and methanol). The electrolyte after the final electrolyzation was filtered through a 0.2 μm filter to trap the residue. The obtained residue was decomposed in an acid, and the mass of Nb in the residue and the mass of W in the residue were determined by ICP-AES. Furthermore, the mass of the finally electrolyzed base metal (austenitic stainless steel material) was determined. Specifically, the mass of the test specimen before the final electrolyzation and the mass of the test specimen after the final electrolyzation were measured. Then, the difference obtained by subtracting the mass of the test specimen after the final electrolyzation from the mass of the test specimen before the final electrolyzation was defined as the mass of the finally electrolyzed base metal. The mass of Nb in the residue was divided by the mass of the finally electrolyzed base metal, and the quotient was subtracted from the content of Nb in the chemical composition of the austenitic stainless steel material. That is, the content of dissolved Nb was determined according to the following Formula (i). Furthermore, the mass of W in the residue was divided by the mass of the finally electrolyzed base metal, and the quotient was subtracted from the content of W in the chemical composition of the austenitic stainless steel material. That is, the content of dissolved W was determined according to the following Formula (ii). The determined content of dissolved Nb and the determined content of dissolved W were summed to determine the sum of the content of dissolved Nb and the content of dissolved W. The sum (mass %) of the content of dissolved Nb and the content of dissolved W is shown in Table 2.

$$\text{content of dissolved Nb} = \text{content of Nb in chemical composition (mass \%)} - (\text{mass of Nb in residue})/(\text{mass of base metal}) \times 100 \quad \text{(i)}$$

$$\text{content of dissolved W} = \text{content of W in chemical composition (mass \%)} - (\text{mass of W in residue})/(\text{mass of base metal}) \times 100 \quad \text{(ii)}$$

TABLE 2

| Test number | Solution treatment: Solution treatment temperature (° C.) | Retention time t (minute) | F3 | Sum of content of dissolved Nb and content of dissolved W (mass %) | Creep strength | Creep ductility |
|---|---|---|---|---|---|---|
| 1 | 1200 | 3 | 42 | 6.0 | E | E |
| 2 | 1200 | 3 | 35 | 5.2 | E | E |
| 3 | 1200 | 3 | 32 | 4.0 | E | E |
| 4 | 1200 | 3 | 45 | 7.0 | E | E |
| 5 | 1200 | 3 | 38 | 5.2 | E | E |
| 6 | 1200 | 3 | 39 | 5.5 | E | E |
| 7 | 1200 | 3 | 39 | 4.6 | E | E |

TABLE 2-continued

| Test number | Solution treatment: Solution treatment temperature (° C.) | Solution treatment: Retention time t (minute) | F3 | Sum of content of dissolved Nb and content of dissolved W (mass %) | Creep strength | Creep ductility |
|---|---|---|---|---|---|---|
| 8 | 1200 | 3 | 36 | 4.6 | E | E |
| 9 | 1200 | 3 | 43 | 6.1 | E | E |
| 10 | 1200 | 3 | 34 | 4.5 | E | E |
| 11 | 1200 | 3 | 42 | 5.6 | E | E |
| 12 | 1200 | 3 | 35 | 4.6 | E | E |
| 13 | 1100 | 2 | 27 | 3.5 | E | E |
| 14 | 1200 | 3 | 45 | 6.6 | B | B |
| 15 | 1200 | 3 | 30 | 2.8 | B | B |
| 16 | 1200 | 3 | 37 | 4.0 | E | B |
| 17 | 1200 | 3 | 37 | 5.6 | B | E |
| 18 | 1200 | 3 | 34 | 5.0 | B | B |
| 19 | 1200 | 3 | 28 | 3.2 | B | B |
| 20 | 1200 | 3 | 46 | 6.8 | B | B |
| 21 | 1200 | 3 | 47 | 7.2 | B | B |
| 22 | 1000 | 1 | 21 | 3.1 | B | B |

[Evaluation Test for Creep Strength and Creep Ductility]

A creep rupture test specimen complying with JIS Z2271 (2010) was formed from the midpoint of the plate width and the midpoint of the plate thickness of the steel plate of each number. The creep rupture test specimen had a diameter of 6 mm, and the parallel portion of the test specimen had a length of 30 mm. The parallel portion was parallel to the direction of rolling of the steel plate. Using the formed creep rupture test specimen, a creep rupture test complying with JIS Z2271 (2010) was performed. Specifically, the creep rupture test was performed after the creep rupture test specimen was heated to 800° C. The test stress was set at 10 MPa, and the creep rupture time (hours) and the reduction of area after creep rupture (%) were determined.

[Evaluation of Creep Strength]

If the creep rupture time was 2000 hours or more, the creep strength of the test specimen in the high-temperature environment was determined to be high (shown as "E" (Excellent) in Table 2). On the other hand, if the creep rupture time was less than 2000 hours, the creep strength of the test specimen in the high-temperature environment was determined to be low (shown as "B" (Bad) in Table 2).

[Evaluation of Creep Ductility]

If the reduction of area after creep rupture was 30% or more, the creep ductility of the test specimen in the high-temperature environment was determined to be excellent (shown as "E" (Excellent) in Table 2). On the other hand, if the reduction of area after creep rupture was less than 30%, the creep ductility of the test specimen in the high-temperature environment was determined to be poor (shown as "B" (Bad) in Table 2).

[Test Results]

Table 2 shows the test results. Referring to Table 1 and Table 2, for the test numbers 1 to 13, the contents of the elements in the chemical composition were appropriate, Formulae (1) and (2) were satisfied, and the sum of the content of dissolved Nb and the content of dissolved W was 3.2 mass % or more. Therefore, the austenitic stainless steel materials of these test numbers had a high creep strength and a high creep ductility in the high-temperature environment.

On the other hand, for the test number 14, the content of C was too high. As a result, the creep strength and the creep ductility were low in the high-temperature environment.

For the test number 15, the content of W was low. As a result, the creep strength and the creep ductility were low in the high-temperature environment.

For the test number 16, the content of B was low. As a result, the creep ductility was low in the high-temperature environment.

For the test number 17, the content of P was low. As a result, the creep strength was low in the high-temperature environment.

For the test number 18, the content of Nb was low. As a result, the creep strength and the creep ductility were low in the high-temperature environment.

For the test number 19, although the contents of the elements in the chemical composition were appropriate, F1 did not satisfy Formula (1). As a result, the creep strength and the creep ductility were low in the high-temperature environment.

For the test numbers 20 and 21, although the contents of the elements in the chemical composition were appropriate, F2 did not satisfy Formula (2). As a result, the creep strength and the creep ductility were low in the high-temperature environment.

For the test number 22, although the contents of the elements in the chemical composition were appropriate, and F1 and F2 were appropriate, the sum of the content of dissolved Nb and the content of dissolved W was too low. As a result, the creep strength and the creep ductility were low in the high-temperature environment.

An embodiment of the present invention has been described above. However, the embodiment described above is only an example of an implementation of the present invention. Therefore, the present invention is not limited to the embodiment described above, and various modifications can be made to the embodiment described above as required without departing from the spirit of the present invention.

The invention claimed is:

1. An austenitic stainless steel material comprising a chemical composition that consists of, in mass %:

C: 0.060% or less,
Si: 1.0% or less,
Mn: 2.00% or less,
P: 0.0010 to 0.0400%,
S: 0.010% or less,
Cr: 10 to 25%,
Ni: 25 to 45%,
Nb: 0.2 to 2.0%,
W: 2.5 to 6.0%,
B: 0.0010 to 0.0100%,
Al: 2.5 to 4.5%,
N: 0 to 0.030%,
Cu: 0 to 2.0%,
Ta: 0 to 3.0%,
Mo: 0 to 3.0%,
Ti: 0 to 0.20%,
V: 0 to 0.5%,
Hf: 0 to 0.10%,
Zr: 0 to 0.20%,
Ca: 0 to 0.008%,
rare earth metal (REM): 0 to 0.10%, and
the balance being Fe and impurities, and satisfies Formulae (1) and (2),
wherein a sum of a content of dissolved Nb and a content of dissolved W is 3.2 mass % or more:

$$(W/184+Nb/93)/(C/12)\geq 5.5 \quad (1)$$

$$(W/184+Nb/93)/(B/11)\leq 450 \quad (2)$$

where a content in mass % of a corresponding element is substituted for each symbol of element in Formulae (1) and (2).

2. The austenitic stainless steel material according to claim 1, wherein the chemical composition contains one or more elements selected from a group consisting of:

Cu: 0.1 to 2.0%,

Ta: 0.1 to 3.0%,

Mo: 0.1 to 3.0%,

Ti: 0.01 to 0.20%, and

V: 0.1 to 0.5%.

3. The austenitic stainless steel material according to claim 1, wherein the chemical composition contains one or more elements selected from a group consisting of:

Hf: 0.01 to 0.10%, and

Zr: 0.01 to 0.20%.

4. The austenitic stainless steel material according to claim 2, wherein the chemical composition contains one or more elements selected from a group consisting of:

Hf: 0.01 to 0.10%, and

Zr: 0.01 to 0.20%.

5. The austenitic stainless steel material according to claim 1, wherein the chemical composition contains one or more elements selected from a group consisting of:

Ca: 0.001 to 0.008%, and rare earth metal (REM): 0.01 to 0.10%.

6. The austenitic stainless steel material according to claim 2, wherein the chemical composition contains one or more elements selected from a group consisting of:

Ca: 0.001 to 0.008%, and rare earth metal (REM): 0.01 to 0.10%.

7. The austenitic stainless steel material according to claim 3, wherein the chemical composition contains one or more elements selected from a group consisting of:

Ca: 0.001 to 0.008%, and rare earth metal (REM): 0.01 to 0.10%.

8. The austenitic stainless steel material according to claim 4, wherein the chemical composition contains one or more elements selected from a group consisting of:

Ca: 0.001 to 0.008%, and rare earth metal (REM): 0.01 to 0.10%.

* * * * *